US007559302B2

(12) United States Patent
Cullen et al.

(10) Patent No.: US 7,559,302 B2
(45) Date of Patent: Jul. 14, 2009

(54) THERMALLY INSULATING ELEMENT FOR AN ENGINE VALVE ASSEMBLY

(75) Inventors: John Cullen, Mequon, WI (US); Mike Youakim, Wauwatosa, WI (US); Christopher Monaco, Antioch, IL (US); Jason Youd, Mooresville, NC (US); Ron Check, Brighton, MI (US)

(73) Assignee: Harley-Davidson Motor Company Group, LLC, Milwaukee, WI (US)

( * ) Notice: Subject to any disclaimer, the term of this patent is extended or adjusted under 35 U.S.C. 154(b) by 0 days.

(21) Appl. No.: 11/940,373

(22) Filed: Nov. 15, 2007

(65) Prior Publication Data

US 2009/0126673 A1 May 21, 2009

(51) Int. Cl.
*F01L 1/16* (2006.01)
*F01L 3/10* (2006.01)

(52) U.S. Cl. ..... 123/90.49; 123/90.67; 123/188.6; 123/188.11

(58) Field of Classification Search ..... 123/90.49, 123/90.67, 188.6, 188.12, 188.17, 188.11, 123/188.13, 90.65–90.66
See application file for complete search history.

(56) References Cited

U.S. PATENT DOCUMENTS 2,613,656 A * 10/1952 Leach ..... 123/90.29
2,868,188 A * 1/1959 Havens ..... 123/188.1
2,935,979 A * 5/1960 Havens ..... 123/188.1
3,577,972 A * 5/1971 Moray ..... 123/188.6
5,044,330 A * 9/1991 Havens et al. ..... 123/90.67
6,113,546 A * 9/2000 Suorsa et al. ..... 600/459
6,119,645 A * 9/2000 Hesher ..... 123/188.6
6,529,103 B1 * 3/2003 Brendel et al. ..... 333/182
6,571,761 B1 * 6/2003 Leimer ..... 123/188.6
6,789,790 B2 * 9/2004 Speckhart et al. ..... 267/204
6,848,671 B2 * 2/2005 Hegemier et al. ..... 251/214
6,938,877 B2 * 9/2005 McArthy et al. ..... 251/214
7,299,779 B2 * 11/2007 Hegemier et al. ..... 123/188.6
7,438,036 B2 * 10/2008 Hesher et al. ..... 123/90.37
2004/0021122 A1 * 2/2004 McArthy et al. ..... 251/337
2008/0060599 A1 * 3/2008 Kees et al. ..... 123/151

OTHER PUBLICATIONS

DuPont; "Table 1 Summary of typical properties standard SP polyimide resins"; Feb. 21, 2007; http://www2.dupont.com/Vespel/en_US/Literature/sp1/pdf.
DuPont; "Properties of DuPont VESPEL® Parts"; pp. 3, 5, 7; Feb. 21, 2007; http://www2.dupont.com/Vespel/en_US/Literature/233630a.pdf.

* cited by examiner

*Primary Examiner*—Hai H Huynh
(74) *Attorney, Agent, or Firm*—Michael Best & Friedrich LLP

(57) ABSTRACT

A cylinder head assembly for an internal combustion engine including a cylinder head at least partially defining a flow path through the engine, including an intake port, an exhaust port, and a combustion chamber disposed between the intake port and the exhaust port. A valve is coupled to the cylinder head and movable relative to the cylinder head to selectively open the combustion chamber to one of the intake port and the exhaust port. A valve spring is positioned between the valve and the cylinder head and biases the valve to a closed position. A thermally insulating washer is positioned between the cylinder head and the valve spring.

19 Claims, 5 Drawing Sheets

THERMALLY INSULATING ELEMENT FOR AN ENGINE VALVE ASSEMBLY

BACKGROUND

Known internal combustion engines include valves that control the flow of intake air into a combustion chamber and the flow of exhaust gases out of the combustion chamber. A valve assembly, part of which is positioned within a rocker box of the engine, includes a spring configured to bias the valve to a closed position. A valve stem seal is provided on a stem of the valve to prevent oil within the rocker box from entering the combustion chamber and conversely, to prevent exhaust gases from entering the rocker box. Typically, valve springs and valve stem seals are subject to conduction heating from the heat of combustion absorbed into a cylinder head. High temperatures and repeated temperature cycling (between periods of operation and periods of non-operation) of the valve springs and valve stem seals can lead to decreased closing force on the valve, valve stem seal degradation, and increased oil consumption by the engine.

SUMMARY

In one embodiment, the invention provides a cylinder head assembly for an internal combustion engine. The cylinder head assembly includes a cylinder head at least partially defining a flow path through the engine. The flow path includes an intake port, an exhaust port, and a combustion chamber disposed between the intake port and the exhaust port. A valve is coupled to the cylinder head and movable relative to the cylinder head to selectively open the combustion chamber to one of the intake port and the exhaust port. A valve spring is positioned between the valve and the cylinder head and biases the valve to a closed position. A thermally insulating washer is positioned between the cylinder head and the valve spring.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
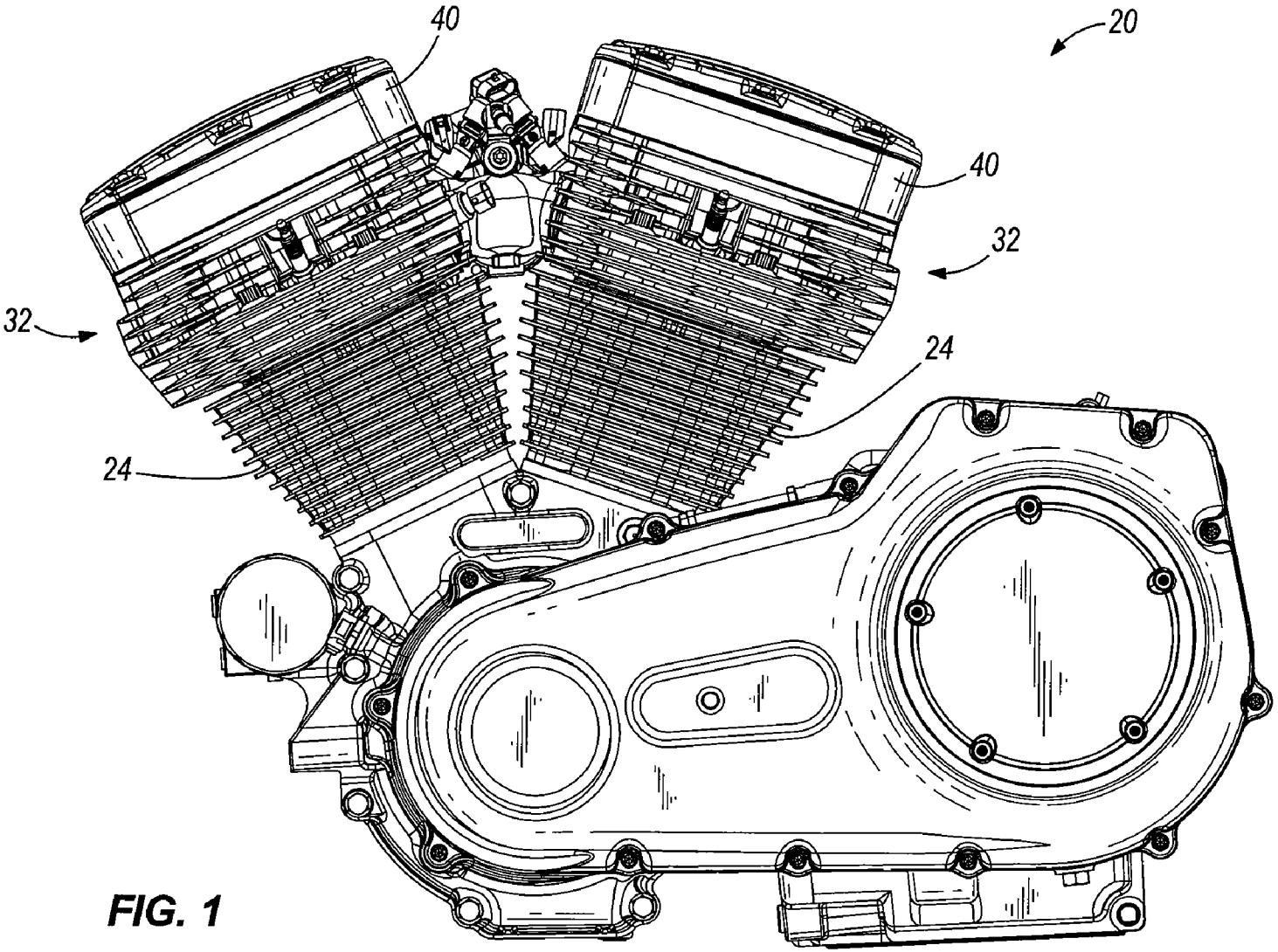
FIG. 1 is a side view of an internal combustion engine including a cylinder head assembly according to the present invention.
Figure 4:
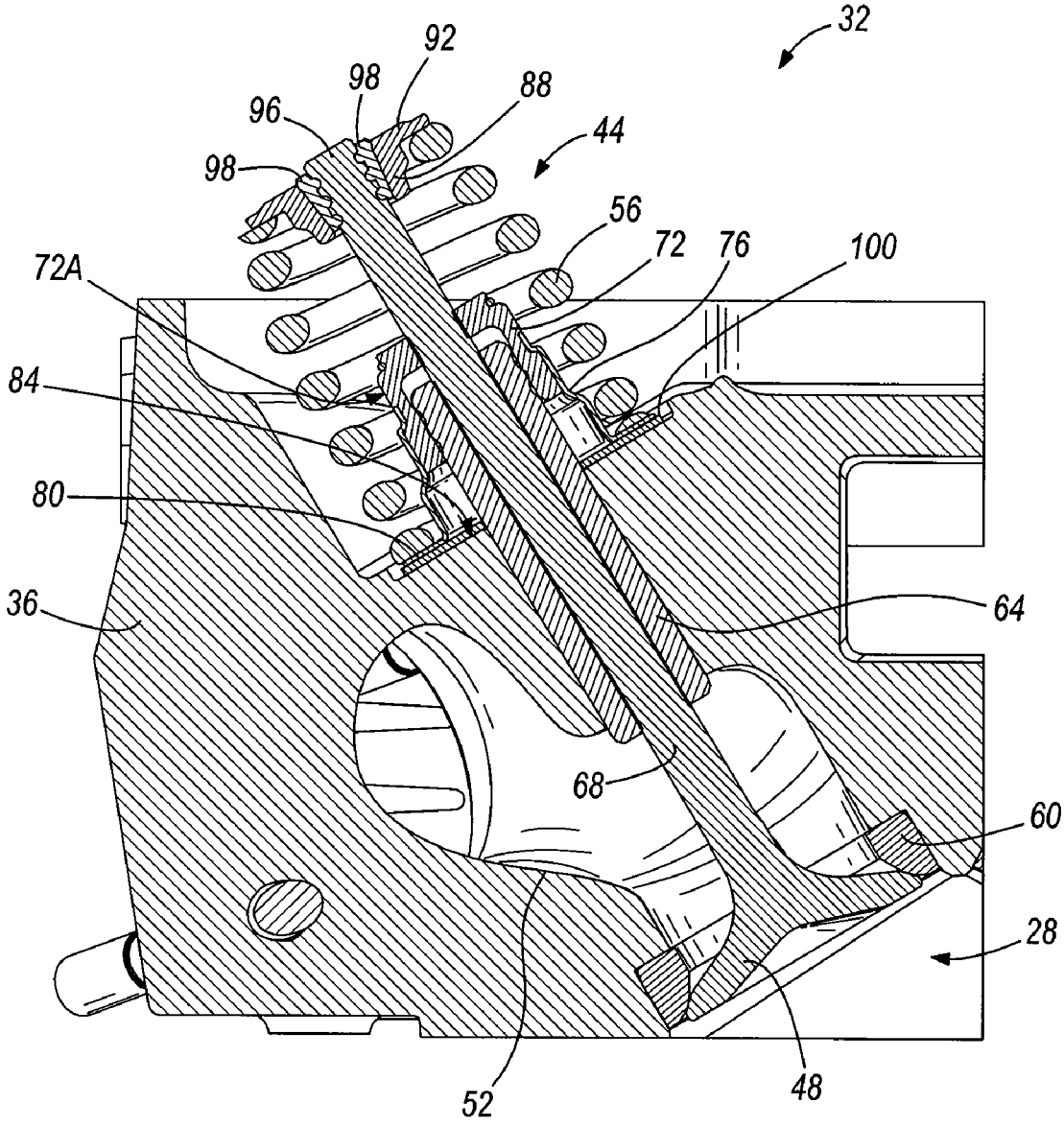
FIG. 4 is a cross-sectional view of the cylinder head assembly, taken along line 4-4 of FIG. 2.

FIG. 1 illustrates a motorcycle engine 20 (e.g., a V-twin type internal combustion engine). The motorcycle engine 20 includes cylinders 24 defining a pair of cylinder bores (not shown). Each of the cylinders 24 receives a piston, which reciprocates therein to compress fuel and air prior to combustion within a combustion chamber 28 (FIG. 4). A cylinder head assembly 32 is positioned above each one of the cylinders. The cylinder head assemblies 32 include cylinder heads 36 (FIG. 2) that combine with the pistons to define the combustion chambers 28. A cylinder head cover 40 of each cylinder head assembly 32 is coupled to each cylinder head 36.

Figure 2:
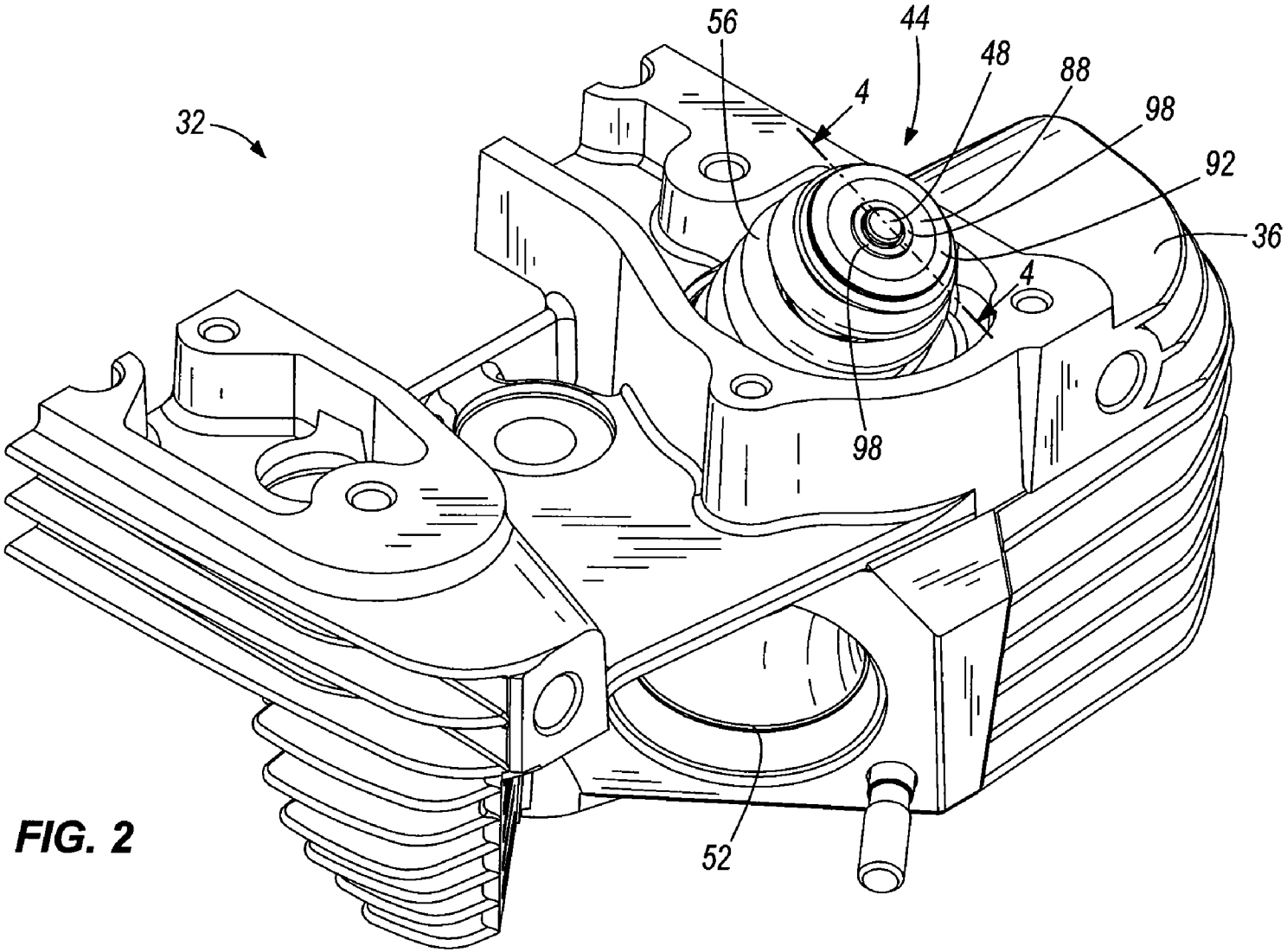
FIG. 2 is perspective view of a portion of the cylinder head assembly of FIG. 1.
Figure 3:
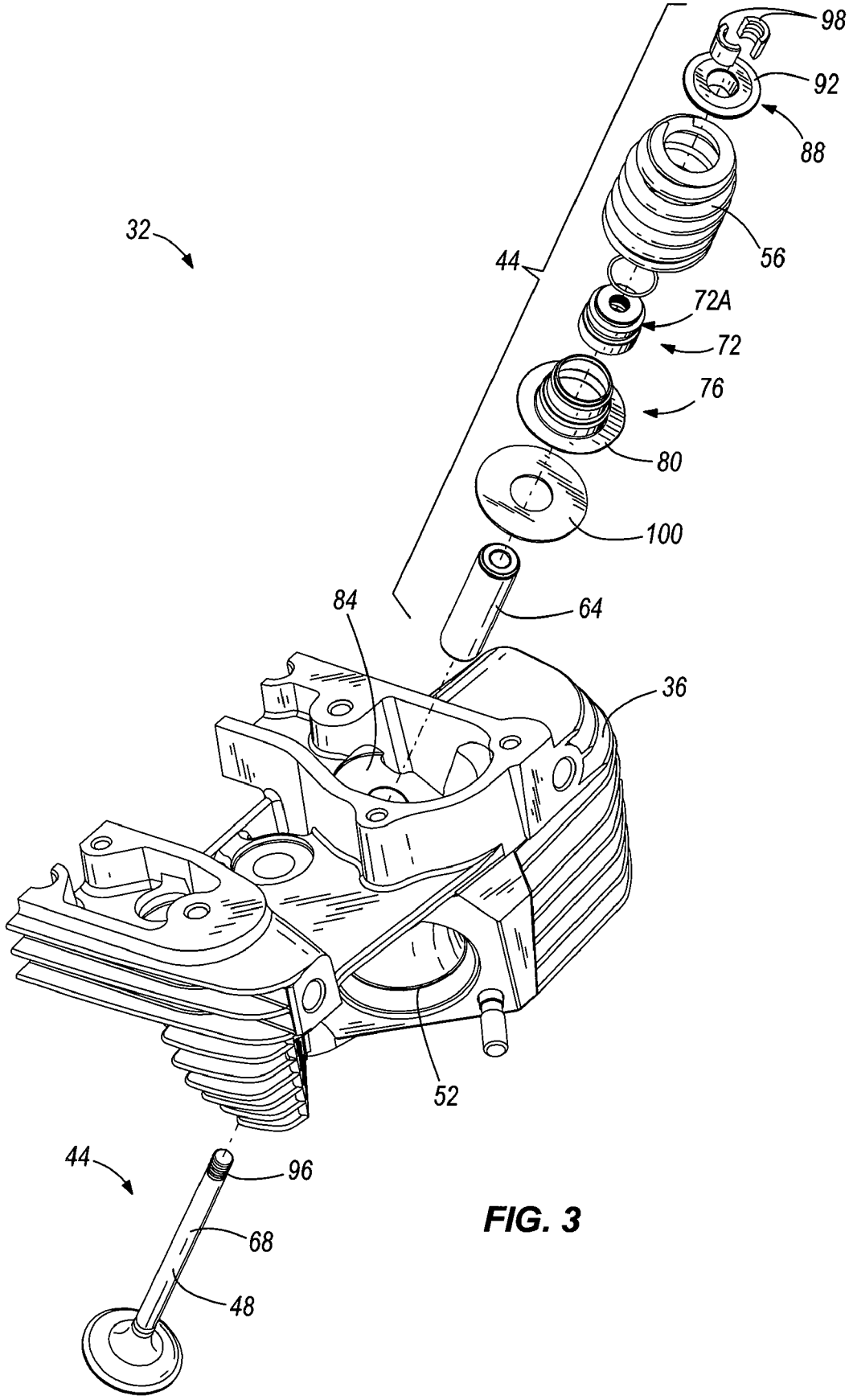
FIG. 3 is an exploded view of the portion of the cylinder head assembly shown in FIG. 2.
Figure 5:
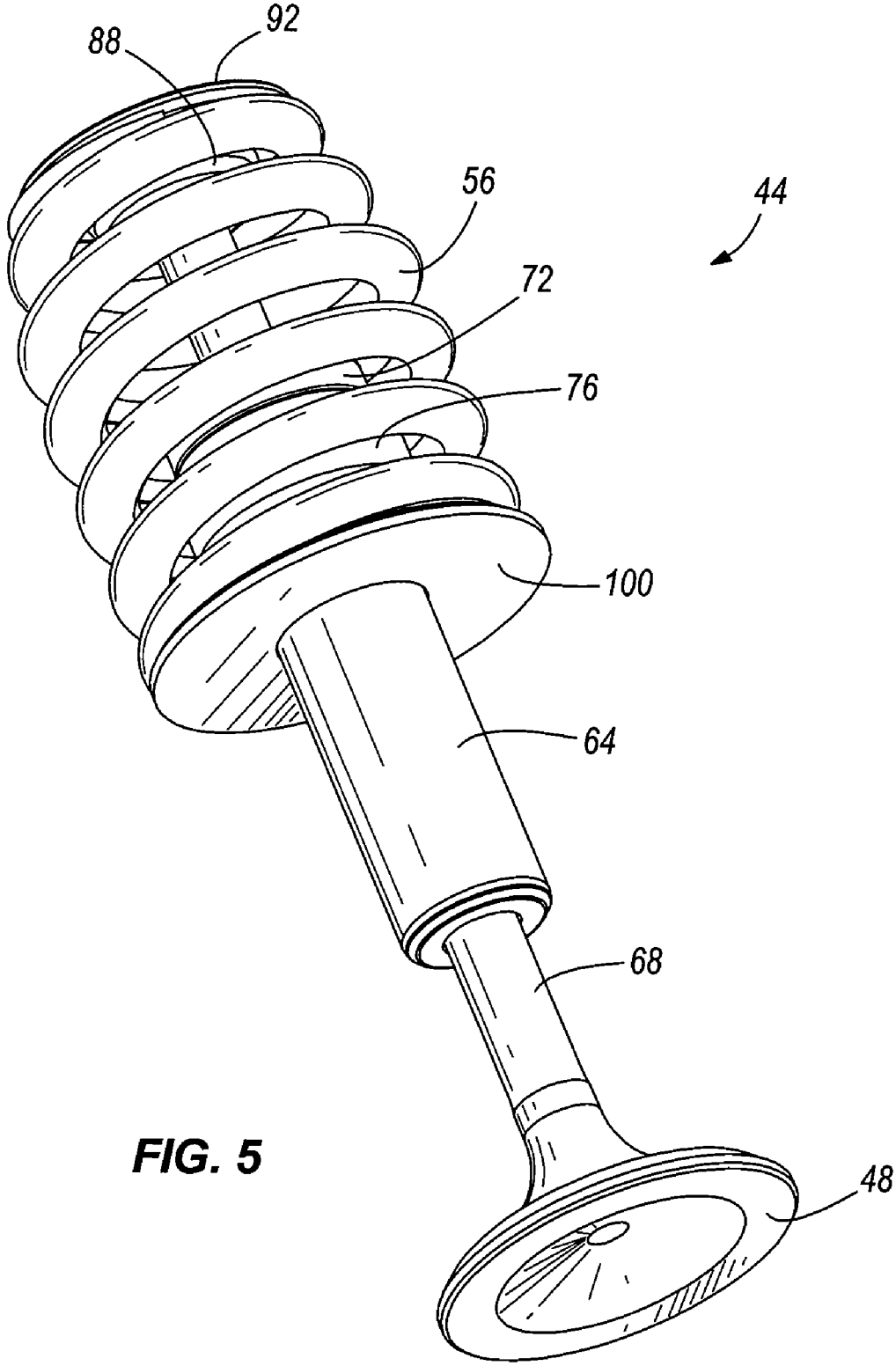
FIG. 5 is a perspective view of a valve assembly removed from a cylinder head of the cylinder head assembly.

FIG. 2 is a partial view of one of the cylinder heads 36 having the cylinder head cover 40 removed to illustrate a valve assembly 44. As shown in FIGS. 3-5, the valve assembly 44 includes a valve such as an exhaust valve 48. FIG. 4 is a section view illustrating the valve assembly 44 assembled in the cylinder head 36 with the exhaust valve 48 in a closed position. The exhaust valve 48 is axially movable to selectively open the combustion chamber 28 to an exhaust port 52 in the cylinder head 36 to allow exhaust gases to escape the combustion chamber 28. A valve spring 56, such as a coil spring, of the valve assembly 44 biases the exhaust valve 48 to the closed position, shown in FIG. 4, in which the exhaust valve 48 seals against a valve seat 60 in the cylinder head 36. Although not shown, the cylinder head 36 also defines an intake port in selective fluid communication with the combustion chamber 28 (via an intake valve similar to the exhaust valve 48) to provide intake air and/or fuel into the combustion chamber 28.

During operation of the engine 20, and after the power stroke of the piston is completed in one of the cylinders, the exhaust stroke commences to expel the exhaust gases out of the cylinder. During the exhaust stroke, the exhaust valve 48 is actuated (i.e., by a cam—not shown) to an open position. The exhaust valve 48 is moved from the closed position to the open position against the bias of the valve spring 56. As described in further detail below, the valve assembly 44 is provided with additional components for fluidly and thermally isolating the valve spring 56 from the combustion chamber 28 and the exhaust port 52.

In addition to the valve spring 56, the valve assembly 44 includes a valve guide 64 that contacts an outer surface of a valve stem 68 of the exhaust valve 48, as shown in FIG. 4. The valve guide 64 guides the exhaust valve 48 for axial sliding movement between the closed and open positions. A valve stem seal 72 is coupled to an end of the valve guide 64 adjacent the valve spring 56 and remote from the combustion chamber 28. The valve stem seal 72 provides a sliding seal with the valve stem 68. The valve stem seal 72 fluidly separates the exhaust port 52 from the area surrounding the valve spring 56. For example, the valve stem seal 72 prevents lubricant in the area of the valve spring 56 from reaching the exhaust port 52 and combustion chamber 28, and further prevents exhaust gases from reaching the area surrounding the valve spring 56.

A lower collar 76 of the valve assembly 44 is coupled to the valve stem seal 72. The lower collar 76 is formed to fit an irregular outer surface 72A of the valve stem seal 72 (FIG. 4). In this way, the valve stem seal 72 is axially positioned by the lower collar 76. The lower collar 76 includes a lower flange 80 that extends radially outward between the valve spring 56 and a support surface 84 of the cylinder head 36 (FIGS. 3 and 4). The bias force of the valve spring 56 presses the lower collar 76 towards the support surface 84 so that the lower collar 76 is fixed in one position. Thus, the lower collar 76 defines a substantially stationary position of the valve stem seal 72 during movement of the exhaust valve 48. As the valve stem 68 moves, the valve stem seal 72 remains stationary, and a fluid seal is maintained therebetween.

The valve spring 56 is constrained between a first surface of the lower flange 80 on a lower end of the valve spring 56 (closest to the exhaust port 52) and an upper collar 88 at a second, upper end of the valve spring 56. The upper collar 88 includes an upper flange 92 that extends radially outward to support the upper end of the valve spring 56. As shown in FIG. 4, the upper collar 88 is coupled to an upper end 96 of the valve stem 68. One or more retainers 98 are positioned to mutually engage the upper end 96 of the valve stem 68 and the upper collar 88. In this way, the upper collar 88 moves with the valve stem 68. When the cam actuates the exhaust valve 48 to the open position, the upper collar 88 moves towards the support surface 84 of the cylinder head 36, compressing the valve spring 56. When the cam ceases actuation of the exhaust valve 48, the valve spring 56 returns the exhaust valve 48 to the closed position by acting upon the upper flange 92 of the upper collar 88, which is fixed to the valve stem 68 via the retainers 98.

A thermally insulating element, such as a washer 100, is positioned between the lower collar 76 and the cylinder head 36. Specifically, the thermally insulating washer 100 is positioned between the lower flange 80 of the lower collar 76 and the support surface 84 of the cylinder head 36, the washer 100 having a generally planar surface facing each of the lower flange 80 and the support surface 84. The lower flange 80 includes a second surface (opposite the first surface of the lower flange 80 that faces and supports the valve spring 56) facing the washer 100.

The washer 100 is constructed of a material having relatively low thermal conductivity and a relatively high melting point. The washer 100 thermally insulates the valve spring 56 and the valve stem seal 72 from the high temperatures of the cylinder head 36 in the area of the exhaust port 52. In some embodiments, the thermally insulating washer 100 is as little as 1.0 millimeter thick, although greater thicknesses provide increased insulating effect.

In some embodiments, both the cylinder head 36 and the lower collar 76 are constructed of metallic materials and have relatively high thermal conductivity. For example, the cylinder head 36 may be aluminum and the lower collar 76 may be steel. The thermally insulating washer 100 provides a barrier of high resistance for the conduction of heat from the cylinder head 36 to the lower collar 76 and has a thermal conductivity less than the material used for the cylinder head 36 and the valve spring 56. By limiting heat conduction to the lower collar 76, heat conduction to the valve spring 56 and to the valve stem seal 72 is limited. The presence of the washer 100 lowers the respective material temperatures of the valve spring 56 and the valve stem seal 72 during normal operation of the engine 20. All of the engine components are subject to temperature cycles between periods of operation and periods of non-operation. By limiting the high end of the material temperatures, the magnitude of each temperature cycle and the effects thereof are reduced. Particularly, the valve spring 56 maintains a higher, more consistent closing force upon the exhaust valve 48 when it is thermally insulated by the washer 100. Thermal degradation to the valve stem seal 72 and engine oil consumption are also reduced or prevented by the use of the thermally insulating washer 100 between the lower collar 76 and the cylinder head 36.

In addition to the benefits above, the washer 100 provides a layer of frictional protection between the base of the valve spring 56 and the support surface 84 of the cylinder head 36. Repeated compression and release of the valve spring 56 causes torsional instability, which can lead to erosion of the cylinder head 36 as the bottom end of the valve spring 56 twists. The erosion of the support surface 84 by the valve spring instability is vastly reduced or prevented by use of the washer 100 between the lower collar 76 and the support surface 84.

Although illustrated in the figures as being a simple wafer or washer disposed below the lower flange 80 of the lower collar 76, it is conceived that the washer 100 may be fixed or coupled with the lower collar 76 prior to assembly in the cylinder head 36 (e.g., by inter-engaging recesses and protrusions, adhesive, etc.). Alternatively, the washer 100 may be integrally formed with the lower collar 76, for example by overmolding a thermally insulating material onto the lower flange 80 of the lower collar 76. In order to reduce the number of parts in the valve assembly 44, the lower collar 76 may be primarily constructed of a thermally insulating material rather than providing the separate washer 100. The thickness of the lower flange 80 of the lower collar 76 may be sized accordingly to thermally insulate the valve spring 56 and the valve stem seal 72 from the heat present at the combustion chamber 28 and the exhaust port 52 during operation of the engine 20.

In some embodiments, the thermally insulating washer 100 is constructed primarily of a polyimide material. For example, the washer 100 is constructed of a polyimide material sold under the registered trademark VESPEL of E.I. du Pont de Nemours and Company, available from DuPont Engineering Polymers, Newark, Del. In some embodiments, the washer 100 may be constructed of polyimide with a graphite filler or additive of between about 15 percent and about 40 percent by weight, which provides increased wear resistance and reduced friction compared to an unfilled polyimide base resin. However, in some embodiments, the washer 100 may be constructed of an unfilled polyimide base resin, having a lower thermal conductivity than a graphite-filled polyimide. In some embodiments, the washer 100 has a thermal conductivity less than 0.5 W/m*K. The above-described washer 100 has a thermal conductivity of about 0.3 W/m*K in some embodiments.

Various features and advantages of the invention are set forth in the following claims.

What is claimed is:

1. A cylinder head assembly for an internal combustion engine, the cylinder head assembly comprising:

a cylinder head at least partially defining a flow path through the engine, the flow path including an intake port, an exhaust port, and a combustion chamber disposed between the intake port and the exhaust port;

a valve coupled to the cylinder head and movable relative to the cylinder head to selectively open the combustion chamber to one of the intake port and the exhaust port;

a valve spring positioned between the valve and the cylinder head, the valve spring biasing the valve to a closed position; and a thermally insulating washer positioned between the cylinder head and the valve spring, wherein the thermally insulating washer is constructed primarily of a polyimide.

2. The cylinder head assembly of claim 1, wherein the thermally insulating washer includes a graphite additive between about 15 percent and about 40 percent by weight.

3. The cylinder head assembly of claim 1, wherein the polyimide has a thermal conductivity less than 0.5 W/m·K.

4. The cylinder head assembly of claim 3, wherein the polyimide has a thermal conductivity of about 0.3 W/m·K.

5. The cylinder head assembly of claim 1, wherein the valve is an exhaust valve positioned between the combustion chamber and the exhaust port, the exhaust valve selectively allowing the flow of heated exhaust gases into the exhaust port.

6. The cylinder head assembly of claim 1, wherein the thermally insulating washer is at least 1 millimeter thick.

7. The cylinder head assembly of claim 1, further comprising a collar having a flange with a first surface in contact with the valve spring and a second surface in contact with the thermally insulating washer.

8. The cylinder head assembly of claim 7, wherein the thermally insulating washer is fixed with the collar prior to assembly in the cylinder head.

9. The cylinder head assembly of claim 7, wherein the valve includes a valve stem, the cylinder head assembly further comprising a valve stem seal around the valve stem, the valve stem seal being coupled to the collar and spaced a distance from the thermally insulating washer.

10. An internal combustion engine comprising:

a cylinder head assembly including a cylinder head at least partially defining a flow path through the engine, the flow path including an intake port, an exhaust port, and a combustion chamber disposed between the intake port and the exhaust port;

a valve coupled to the cylinder head and movable relative to the cylinder head to selectively open the combustion chamber to one of the intake port and the exhaust port;

a valve spring positioned between the valve and the cylinder head, the valve spring biasing the valve to a closed position; and a thermally insulating polyimide washer positioned between the cylinder head and the valve spring.

11. The cylinder head assembly of claim 10, wherein the polyimide washer includes a graphite additive between about 15 percent and about 40 percent by weight.

12. The cylinder head assembly of claim 10, wherein the polyimide washer has a thermal conductivity less than 0.5 W/m·K.

13. The cylinder head assembly of claim 12, wherein the polyimide washer has a thermal conductivity of about 0.3 W/m·K.

14. The cylinder head assembly of claim 10, wherein the valve is an exhaust valve positioned between the combustion chamber and the exhaust port, the exhaust valve selectively allowing the flow of heated exhaust gases into the exhaust port.

15. The cylinder head assembly of claim 10, wherein the polyimide washer is at least 1 millimeter thick.

16. The cylinder head assembly of claim 10, further comprising a collar having a flange with a first surface in contact with the valve spring and a second surface in contact with the polyimide washer.

17. The cylinder head assembly of claim 16, wherein the polyimide washer is fixed with the collar prior to assembly in the cylinder head.

18. The cylinder head assembly of claim 16, wherein the valve includes a valve stem, the cylinder head assembly further comprising a valve stem seal around the valve stem, the valve stem seal being coupled to the collar and spaced a distance from the polyimide washer.

19. A cylinder head assembly for an internal combustion engine, the cylinder head assembly comprising:

a cylinder head including a support surface and at least partially defining a flow path through the engine, the flow path including an intake port, an exhaust port, and a combustion chamber disposed between the intake port and the exhaust port;

an exhaust valve coupled to the cylinder head and movable relative to the cylinder head to selectively open the combustion chamber to the exhaust port, a valve stem extending from the exhaust valve;

a valve spring coupled to the exhaust valve and fixedly supported by the support surface of the cylinder head to bias the exhaust valve to a closed position;

a collar having a flange with a first surface in contact with the valve spring and a second surface facing away from the valve spring and toward the support surface;

a valve stem seal surrounding a portion of the valve stem and being coupled to the collar; and a polyimide washer positioned between the second surface of the collar and the support surface to thermally isolate the collar, the valve spring, and the valve stem seal from the cylinder head.

* * * * *